US010492633B2

(12) United States Patent
Li

(10) Patent No.: US 10,492,633 B2
(45) **Date of Patent: *Dec. 3, 2019**

(54) PAPER CUP, A BLANK FOR A PAPER CUP, AND USE OF A PAPER CUP

(71) Applicant: Metsä Board Oyj, Metsä (FI)

(72) Inventor: Alan Li, Äänekoski (FI)

(73) Assignee: Metsä Board Oyj, Äänekoski (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,191

(22) Filed: Jul. 11, 2017

(65) Prior Publication Data

US 2018/0070750 A1 Mar. 15, 2018

Related U.S. Application Data

(63) Continuation of application No. 15/264,636, filed on Sep. 14, 2016, now Pat. No. 9,737,161.

(30) Foreign Application Priority Data

Sep. 9, 2016 (EP) ..... 16188114

(51) Int. Cl.
*A47G 19/22* (2006.01)
*A47G 21/18* (2006.01)
(Continued)

(52) U.S. Cl.
CPC ..... *A47G 19/2205* (2013.01); *A47G 21/18* (2013.01); *B65D 3/06* (2013.01);
(Continued)

(58) Field of Classification Search
CPC ..... A47G 19/2205; A47G 21/18; B65D 3/06; B65D 3/08; B65D 3/20; B65D 5/18;
(Continued)

(56) References Cited

U.S. PATENT DOCUMENTS 2,367,780 A * 1/1945 Inman ..... B65D 5/18 229/113
3,792,810 A 2/1974 Tingley et al.
(Continued)

FOREIGN PATENT DOCUMENTS

CN 204223350 U 3/2015
EP 2949602 A2 12/2015
(Continued)

*Primary Examiner* — Christopher R Demeree
(74) *Attorney, Agent, or Firm* — Seppo Laine Oy

(57) ABSTRACT

According to an example aspect of the present invention, there is provided a paper cup comprising: a base; a sidewall; said base and said sidewall together defining a space for receiving liquid or food; an upper end portion of the cup comprising a first and second pair of opposing closure panels, whereby each panel is attached to an upper edge of the sidewall via a respective first folding line and to adjacent panels via respective second folding lines. Said panels are foldable into a closed position to form a lid of the cup. Each panel of said first pair contains two additional folding lines to enable folding inwards. Upon folding to the closed position, a first panel of said second pair is partly inserted below a second panel of said second pair, and the panels of said second pair close the upper end portion.

13 Claims, 10 Drawing Sheets

(51) Int. Cl.

| | |
|---|---|
| ***B65D 3/08*** | (2006.01) |
| ***B65D 5/18*** | (2006.01) |
| ***B65D 5/42*** | (2006.01) |
| ***B65D 5/74*** | (2006.01) |
| ***B65D 3/06*** | (2006.01) |
| ***B65D 3/20*** | (2006.01) |

(52) U.S. Cl.
CPC ..... *B65D 3/08* (2013.01); *B65D 3/20* (2013.01); *B65D 5/18* (2013.01); *B65D 5/4266* (2013.01); *B65D 5/74* (2013.01)

(58) Field of Classification Search
CPC ..... B65D 5/4266; B65D 5/74; B65D 3/268; B65D 5/0209; B65D 5/061; B65D 5/741
USPC ..... 229/404, 103.1, 138
See application file for complete search history.

(56) References Cited

U.S. PATENT DOCUMENTS

| | | | |
|---|---|---|---|
| 3,809,310 | A | 5/1974 | VanderLugt |
| 4,712,725 | A | 12/1987 | Moore |
| 4,730,766 | A | 3/1988 | Fear |
| 5,358,175 | A | 10/1994 | Cai |
| 5,676,306 | A | 10/1997 | Lankin et al. |
| 6,019,277 | A | 2/2000 | Lundström |
| D456,710 | S | 5/2002 | Persson |
| D469,691 | S | 2/2003 | Brondyke et al. |
| 8,505,807 | B2 | 8/2013 | Herman |
| 2009/0261152 | A1 | 10/2009 | Abbott |
| 2010/0314434 | A1 | 12/2010 | Herman et al. |
| 2015/0144687 | A1 | 5/2015 | Robertson |
| 2015/0272361 | A1 | 10/2015 | Herman et al. |

FOREIGN PATENT DOCUMENTS

| | | | |
|---|---|---|---|
| GB | 850964 | A | 10/1960 |
| GB | 1408714 | A | 10/1975 |
| GB | 2380397 | A | 4/2003 |
| JP | S59141014 | U | 9/1984 |
| JP | 2003072733 | A | 3/2003 |
| JP | 2011518083 | A | 6/2011 |
| JP | 2012527386 | A | 11/2012 |
| JP | 2015143117 | A | 8/2015 |
| KR | 200377993 | Y1 | 3/2005 |
| KR | 20050043450 | A | 5/2005 |
| WO | WO0126980 | A1 | 4/2001 |
| WO | WO2009145795 | A1 | 12/2009 |
| WO | WO2010135613 | A1 | 11/2010 |
| WO | WO2015149048 | A1 | 10/2015 |

* cited by examiner

PAPER CUP, A BLANK FOR A PAPER CUP, AND USE OF A PAPER CUP

FIELD

The present invention relates to closable paper cups.

BACKGROUND

Paper cups are disposable cups that are manufactured from paper or paperboard. The paperboard is usually coated with a layer of polymer, wax or clay on one or either sides to make the cup water-proof. Paper cups are widely used in the food service industry.

Paper cups are meant for single use, after which they are disposed. Depending on the coating, a paper cup can be recycled. For example, cups that are lined with PLA can be fully composted, whereas PE-lined cups should be taken to landfill or incinerated.

Paper cups are often provided with a separate lid for rendering the cup spill-proof. Traditionally, the lids have been manufactured from plastic materials. Most lid models have an opening for a straw or a narrower opening for drinking directly. A major disadvantage of plastic lids is that they must be recycled separately from the paper cup which is made of paperboard.

An additional difficulty relates to the practical use of plastic lids. To close the lid in a liquid-tight manner requires that a user accurately exerts a certain amount of force to the lid edges so that the entire circumference of the lid becomes properly pushed down. If not, spilling may occur during walking due to sloshing of the liquid, or during drinking.

Various solutions have been put forward to develop an improved lid mechanism and to integrate a lid to a paper cup so that both the lid and the cup are made of the same material.

GB 2380397 A discloses a cup with two closure flaps formed integrally with the sidewall of the cup. To close the lid, the flaps are folded inwards to partly overlap each other.

US 2010/314434 A1 also describes a lid mechanism based on two opposing flaps that are integrated to the sidewall of the cup. To close the lid, the flaps are folded inwards to overlap each other entirely. One of the flaps has a tab with adhesive to keep the lid closed.

US 2014/042217 A1 describes a simple lid mechanism comprising two identical flaps that are folded on top of each other.

US 2002/0052286 A1 discloses a one-lid mechanism in which the lid is larger than the cross-section of the main body of the cup. The lid is pushed to some extent inside the body to seal it against the inner surface of the sidewall.

At least some embodiments of the present invention are intended to overcome the above discussed drawbacks and restrictions of the known paper cups and their lids.

SUMMARY OF THE INVENTION

The invention is defined by the features of the independent claims. Some specific embodiments are defined in the dependent claims.

According to a first aspect of the present invention, there is provided a paper cup comprising: a base; a sidewall; said base and said sidewall together defining a space for receiving liquid or food; an upper end portion of the cup comprising a first and second pair of opposing closure panels, whereby each of the closure panels is attached to an upper edge of the sidewall via a respective first folding line and to adjacent closure panels via respective second folding lines; said closure panels being foldable into a closed position to form a lid of the cup; each panel of said first pair containing two additional folding lines, each of which extends from a distal edge of the respective panel to end points of the respective first folding line, to enable folding inwards; wherein, upon folding to the closed position, a first panel of said second pair is partly inserted below a second panel of said second pair, and the panels of said second pair close the upper end portion.

According to a second aspect of the present invention, there is provided a blank for a paper cup.

According to a third aspect of the present invention, there is provided use of the paper cup for holding liquid or food for human or animal consumption.

At least some embodiments of the present invention provide significant advantages over cups with a plastic lid. The recyclability of the cup is facilitated, as the material is the same for the cup and the lid. The lid is more user-friendly, as the required forces and the amount of coordination are reduced. Consumption of the liquid is easier through a spout in the edge of one of the closure panels instead of a small opening in the top surface of a plastic lid. Filling the cup near the maximum level is easier, because in the open configuration the closure panels prevent splashing of the liquid.

Further, a plastic lid requires that the cup is manufactured from paperboard with a particular thickness to ensure liquid tightness. Manufacturing of moulds for plastic lids is expensive, meaning that dimensions of the lid cannot be easily adjusted or changed, which limits the choice of suitable paperboards. In the present invention, this disadvantage can be avoided as the lid is formed of the same materials as the cup.

Some embodiments of the present invention provide further advantages over the known solutions of integrating a lid to a paper cup. The lid is more reliable in terms of liquid tightness both during closing and handling, for example during walking and drinking. The user does not have to keep pressing the folded flaps to keep the lid securely closed. The position of the spout is more natural, providing a feeling of drinking from a paper cup without a lid and with a circular rim.

EMBODIMENTS

Definitions

In the present context, the term "paper cup" comprises cups and other corresponding receptacles with an approximately circular or rectangular base and made of coated or uncoated paper or paperboard, which cups are aimed at holding liquid or food for human or animal consumption.

The present invention provides an improved lid mechanism for a paper cup. The paper cup comprises a sidewall folded to an approximately tubular or hollow shape, and a base. The lower edge of the sidewall is attached to the base. The lid is based on four closure panels integrated or attached to an upper edge of the sidewall. The closure panels can be folded inwards and locked in place in a liquid-tight manner.

The panels can be formed as flaps that are separately attached to the sidewall of the cup. However, in a preferred embodiment, the panels are formed as extensions of the sidewall so that the panels are attached to each other from their sides at least partly, to form a continuous extension of the sidewall. Preferably, the panels and the sidewall are formed of the same material.

In the following, embodiments are discussed in more detail with reference to the accompanying drawings.

Figure 1A:
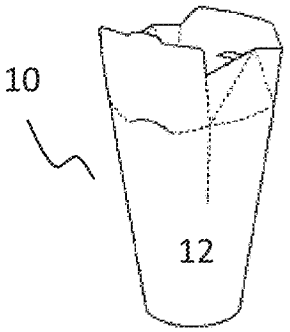
FIGS. 1A-1E illustrate closing of a cup for hot beverage in accordance with at least some embodiments of the present invention.
Figure 1B:
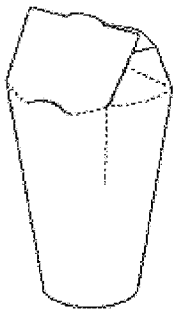
Figure 1C:
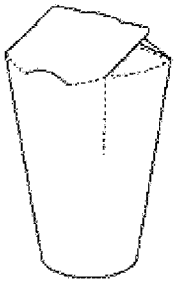
Figure 1D:
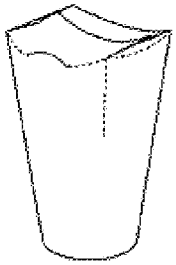
Figure 1E:
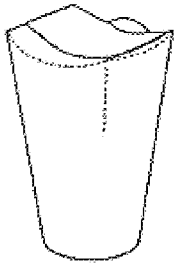
Figure 2:
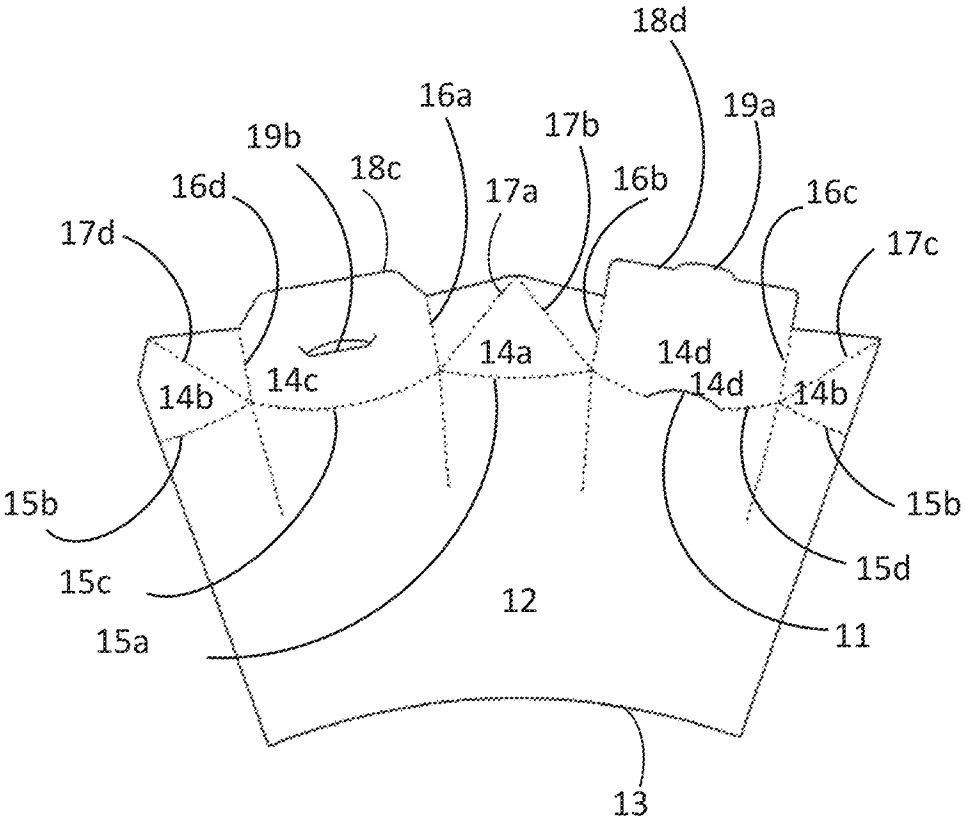
FIG. 2 shows a blank for a cup for hot beverage in accordance with at least some embodiments of the present invention.
Figure 3A:
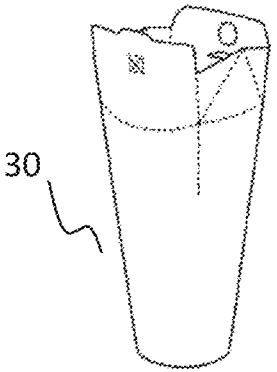
FIGS. 3A-3E illustrate closing of a cup for cold beverage in accordance with at least some embodiments of the present invention.
Figure 3B:
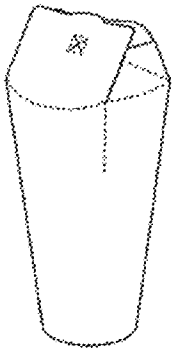
Figure 3C:
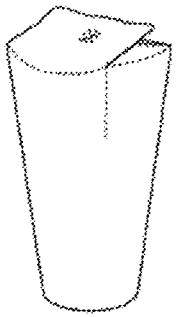
Figure 3D:
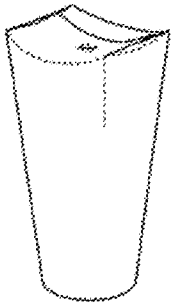
Figure 3E:
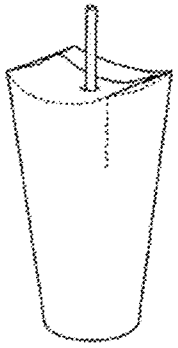

FIGS. 1A-1E illustrate how a cup 10 for hot beverages in accordance with at least some embodiments of the present invention is closed by folding its upper part. The cup 10 has a base (not shown) and a sidewall 12 that is attached to the base from its lower edge 13. FIG. 2 shows a blank for the cup of FIGS. 1A-1E. The upper part of the cup 10 contains closure panels 14*a*-14*d* that can be folded inwards to close the cup 10 and to form an integrated lid to it. In FIG. 1A the cup is in an open configuration or open position, in which liquid can be inserted or poured to the space defined by the base and the sidewall 12. To form the lid, the first pair of closure panels 14*a*, 14*b* is folded first inwards (see FIGS. 1B and 1C) and the second pair of closure panels 14*c*, 14*d* is folded subsequently to convert the upper part to a closed configuration or closed position.

Each of the closure panels is attached to the sidewall and to adjacent panels by folding lines. The panels 14*a*, 14*b*, 14*c* and 14*d* are attached to the sidewall via the respective (approximately horizontal) first folding lines 15*a*, 15*b*, 15*c* and 15*d*. The panels are attached to each other via the (approximately vertical) second folding lines. The first folding lines 15*a*-15*d* are arcuate while the second folding lines 16*a*-16*d* are straight in this embodiment. The panel 14*b* is initially split to two separate parts in the blank which are united to form a single panel when the blank is assembled to a cup.

To enable folding of the panels 14*a* and 14*b* of the first pair, they contain additional folding lines within the panel. Panel 14*a* contains two additional folding lines 17*a* and 17*b* that form a shape of a triangle with a curved base together with the folding line 15*a*. The apex of the triangle extends to the distal edge of the panel 14*a*. The base of the triangle is the curved folding line 15*a*. The panel 14*b* has a similar structure: the additional folding lines 17*c* and 17*d* form a triangle with a curved base together with the folding line 15*b*. To fold the panels 14*a*, 14*b* inwards, the respective triangle parts are pushed down.

In other embodiments, the additional folding lines 17*a*-17*d* of the panels 14*a* and 14*b* may have another shape and locations within the panels 14*a*, 14*b*. For example, the triangle part may have a curved base and a cut apex.

The panels 14*c* and 14*d* of the second pair do not have additional folding lines, and they form the top surface of the lid. The length of the panels 14*c* and 14*d*, as measured from the respective folding lines 15*c* and 15*d* to the respective distal edges 18*c*, 18*d* of the panels 14*c*, 14*d*, is longer than the corresponding length of the panels 14*a* and 14*b*. The panel 14*c* is adapted to be partly inserted below the panel 14*d*. Locking of the lid is achieved by inserting a tongue 19*a* located in the distal edge 18*d* of the panel 14*d* into a receiving opening 19*b* in the panel 14*c*.

The folding line 15*d* of the panel 14*d* of the second pair has an opening 11 to form a spout for drinking or pouring of the contents. In other embodiments, the opening may be provided any suitable shape and position, for example an opening that follows the general curved shape of the first folding line.

Figure 4:
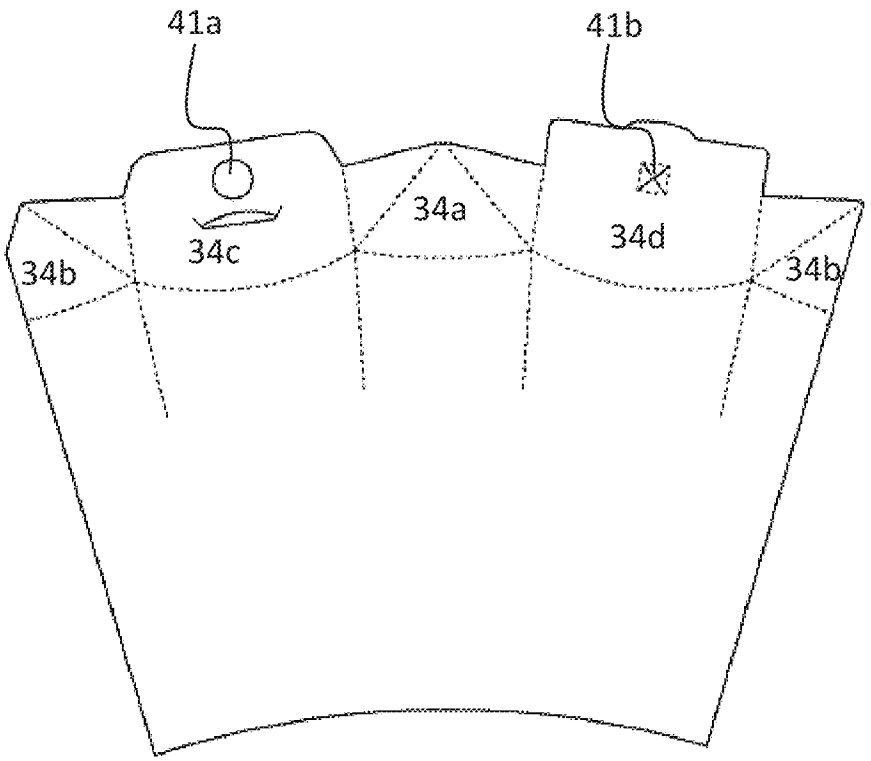
FIG. 4 shows a blank for a cup for cold beverage in accordance with at least some embodiments of the present invention.
Figure 5A:
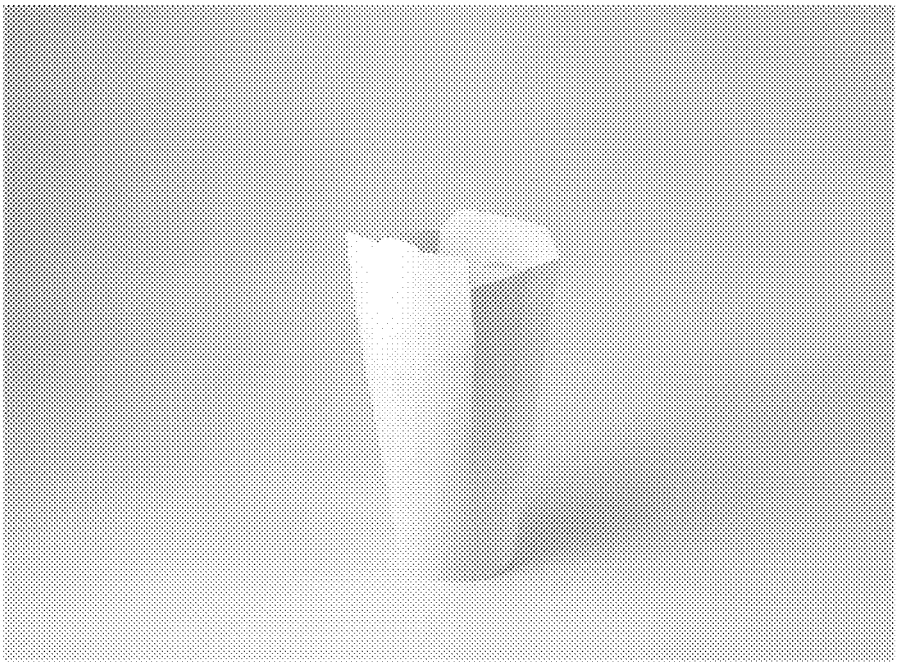
FIGS. 5A-5E illustrate closing of a cup for hot beverage in accordance with at least some embodiments of the present invention.
Figure 5B:
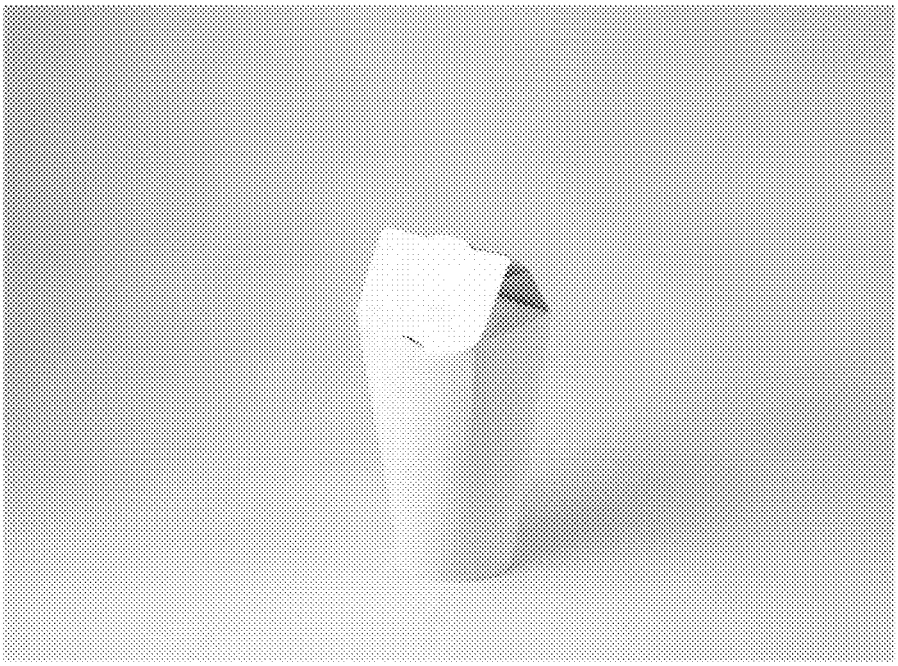
Figure 5C:
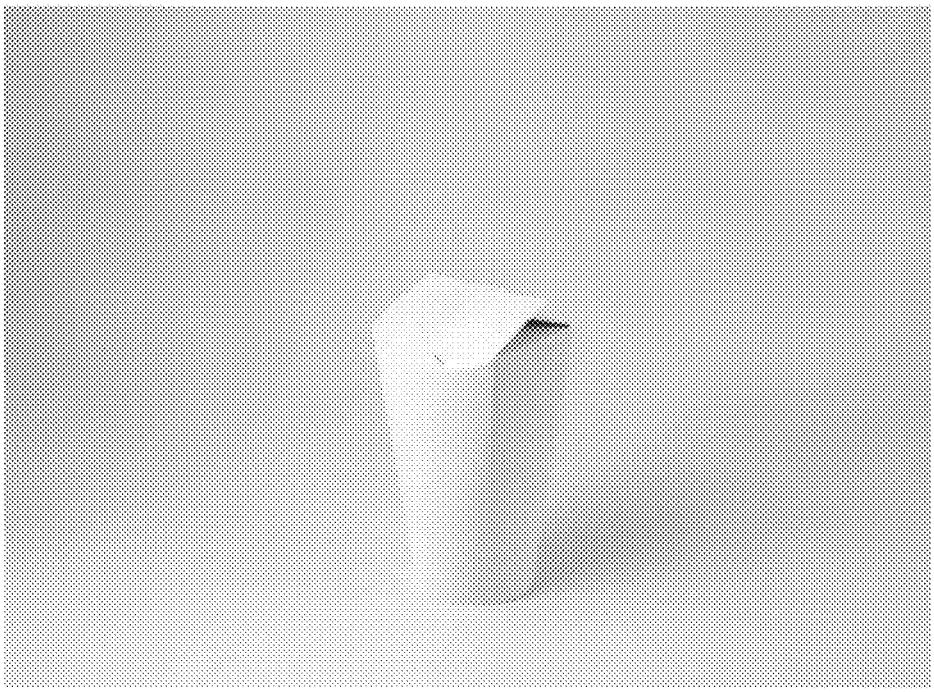
Figure 5D:
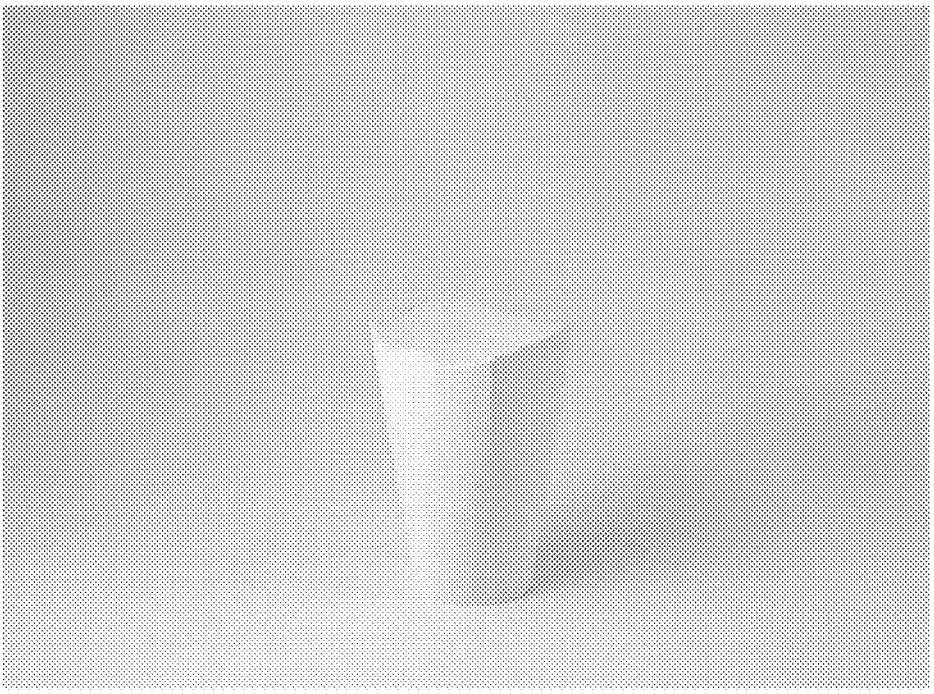
Figure 5E:
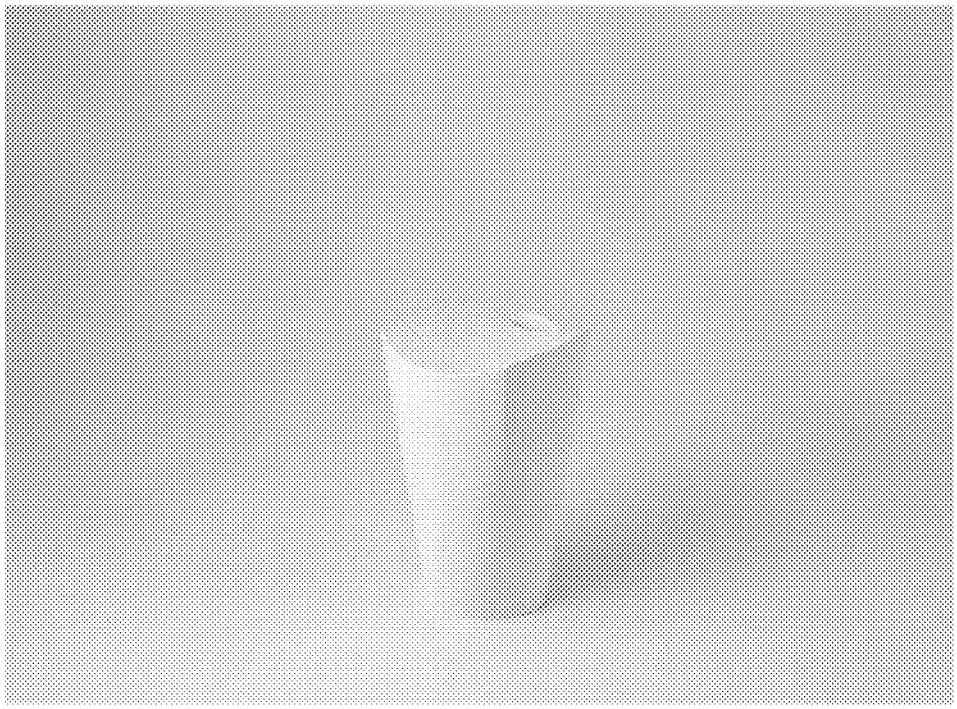
Figure 6A:
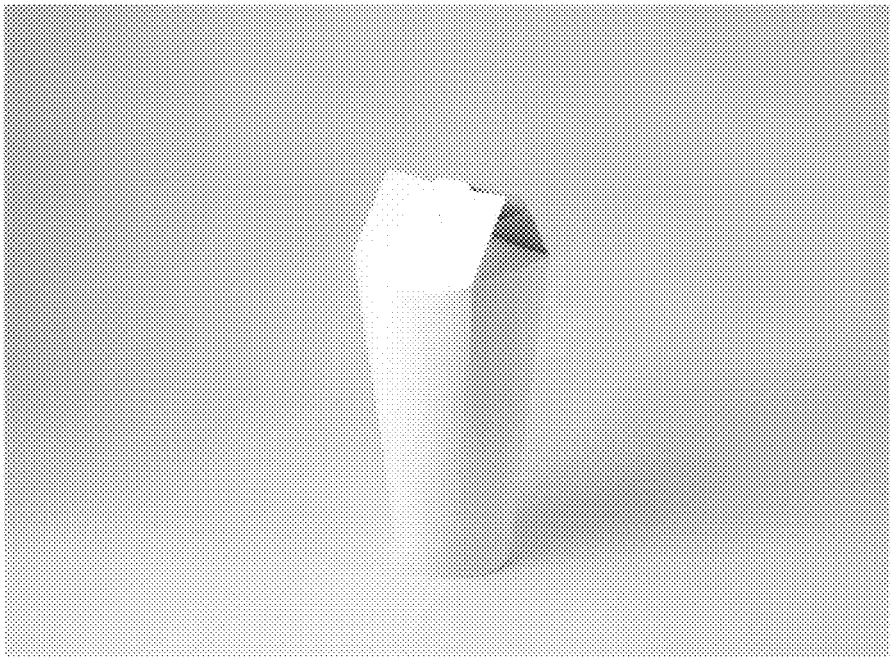
FIGS. 6A-6E illustrate closing of a cup for cold beverage in accordance with at least some embodiments of the present invention
Figure 6B:
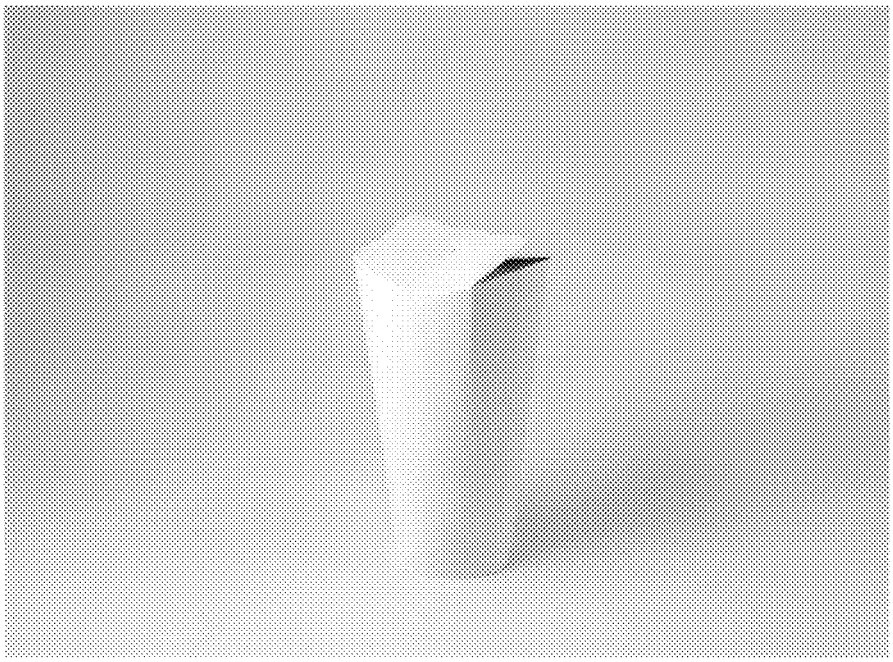
Figure 6C:
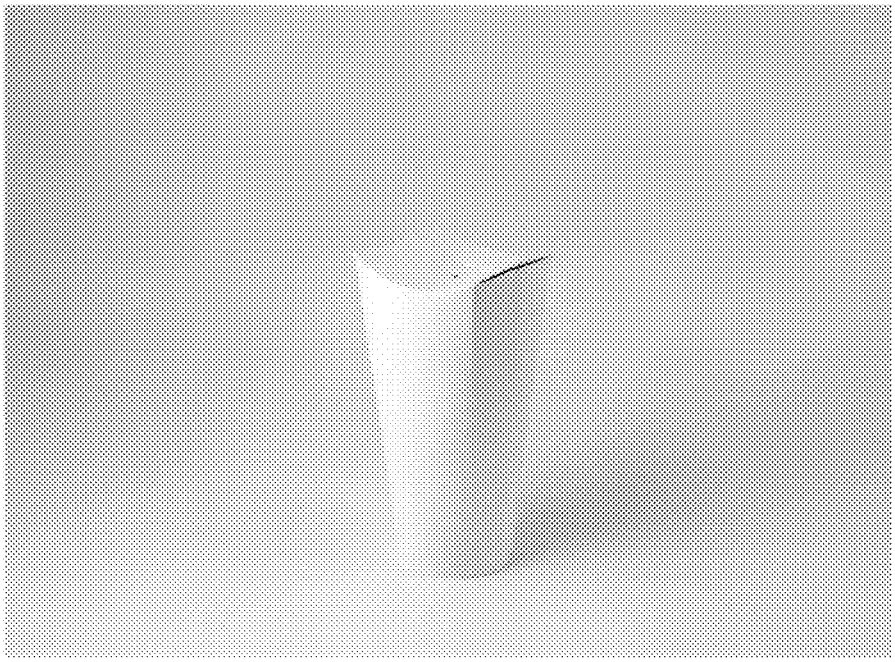
Figure 6D:
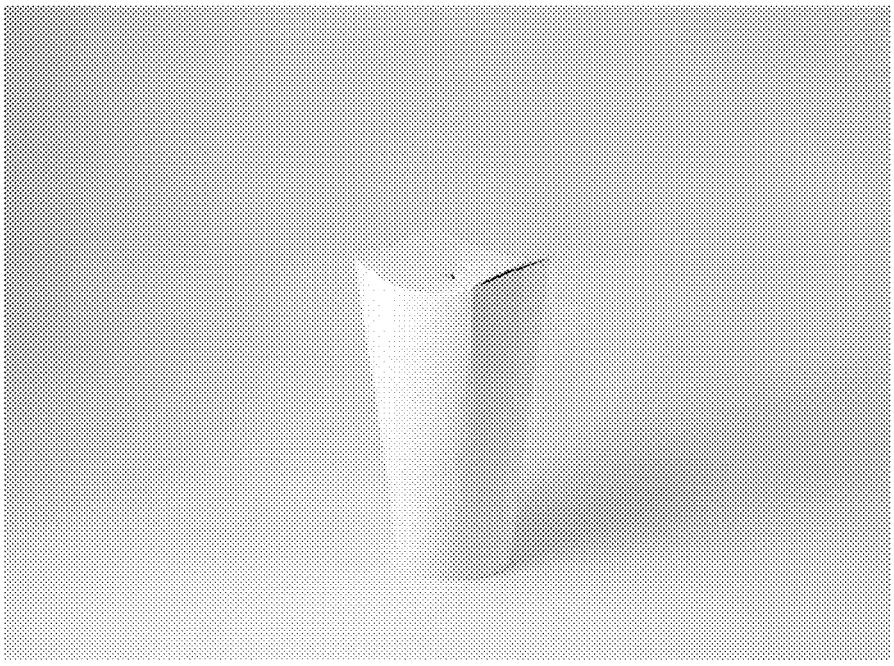
Figure 6E:
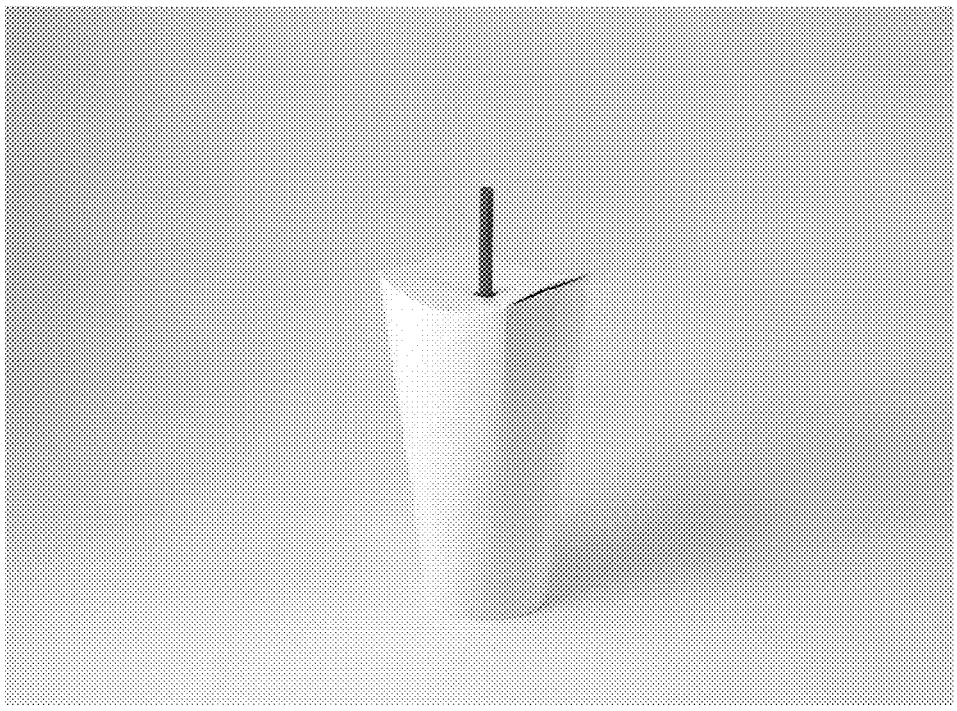

FIGS. 3A-3E illustrate how a cup 30 for cold beverages in accordance with at least some embodiments of the present invention is closed by folding its upper part. FIG. 4 show a blank for the cup of FIGS. 3A-3E. The basic structure of the cup 30 is similar to the cup 10. The cup contains a first pair of opposing closure panels 34*a*, 34*b*, and a second pair of opposing closure panels 34*c*, 34*d*. The cup 30 contains a hole for inserting a straw through the lid in the closed configuration. The hole is formed by a first opening 41*a* in the panel 34*c* and a second opening 41*b* in the panel 34*d*. When the panels are folded inwards to close the lid, the first and second openings 41*a*, 41*b* coincide and produce a hole for inserting a straw. The panels 34*a*, 34*b* of the first pair do not cover or close the entire upper end when folded in order not to block the hole formed by the first and second openings 41*a*, 41*b*. In this embodiment, there is no spout. In other embodiments, the cup may include both a spout and a hole for a straw.

In some embodiments, the spout is located in either or both of the panels of the second pair. In a preferred embodiment, the spout is located in the first folding line of the panel that contains the tongue to prevent any risk of spilling through the opening that receives the tongue.

In the closed configuration, the lid preferably has a concave shape. The curvature of the lid is preferably such that the lowest point (the centre) of the lid is 5 mm to 15 mm, preferably about 10 mm, lower than the highest point (the first folding lines 15*a*, 15*b*) of the lid.

The shape of the base can be for example circular, oval, rectangular or square.

In one embodiment, the length of the panels of the second pair is greater than the length of the panels of the first pair. Preferably the ratio of said lengths is in the range 4:3 to 5:3.

In one embodiment, each of the panels of the first pair has a length that is less than 50% of the width of the panels of the second pair.

In one embodiment, each of the panels of the second pair has a length that is greater than 50% of the width of the panels of the first pair.

In one embodiment, the width of the panels of the first pair is from 5 cm to 8 cm, preferably from 5.5 cm to 7 cm. The shape of these panels may be slightly widening, for example by 10 to 20%, from the respective first folding line towards the opposite distal edge.

In one embodiment, the width of the panels of the second pair is from 6 cm to 9 cm, preferably from 6.5 to 8.5 cm. The shape of these panels, or only the panel 14*c*, 34*c* containing a receiving opening, may be slightly narrowing, for example by 10 to 20%, from the respective first folding line towards the opposite distal edge.

The cup can comprise any sheet-like material capable of being bent along the folding lines to form an integrated lid as explained above. Thus, in one embodiment, the cup comprises paperboard. In another embodiment, the cup comprises a composite material containing both natural and synthetic fibres. In a third embodiment, the cup comprises a thermoplastic polymer material.

In one embodiment, the material of the cup is coated or uncoated multiply paperboard with at least two overlapping fibrous layers. In the case of a multiply structure of three or more plies, at least one middle ply is preferably made of bleached chemical pulp and bleached chemi-thermo mechanical pulp (CTMP). The outer plies are preferably made of bleached chemical pulp. In one embodiment, the paperboard is provided with a barrier coating. Thus, the paperboard can be coated with clay or talc or other suitable platy pigment or mixtures thereof in particular for cold beverage applications. In some embodiments, the paperboard may have a coating consisting of a polymer film. Examples of such coatings include a biopolymer coating, a PE coating, a multilayer barrier coating or a PP coating on one or both sides. In some embodiments, the cup according to the present invention may be recyclable, depending on the barrier material and local recycling services.

Naturally, it is possible to incorporate liquid barrier films into the structure of cup material. In one embodiment, the cup comprises a multi-layered structure, wherein at least one inner layer is a barrier layer. Such a layer can be a coating, preferably an integral coating layer including a polymeric binder, or it can be formed by a polymer film.

In one embodiment, the volume of the cup may be for example from 2 dl to 6 dl.

Preferably, the cup is used for holding cold or hot beverages, such as coffee, tea, hot chocolate, juice, and carbonated drinks. In some embodiments, the cup can be used for other liquids or flowable materials that are intended for human or animal consumption. The cup with the closable lid can also be used as a container for dry and optionally edible products, such as popcorn, chips, nuts, sweets, confectionary, and chocolates.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in serving hot and cold beverages in food service industry, for example in coffee shops and fast food restaurants.

ACRONYMS LIST

PE polyethylene
PP polypropylene
PLA polylactic acid

REFERENCE SIGNS LIST

| | |
|---|---|
| 10 | cup for hot beverages |
| 11 | opening |
| 12 | sidewall |
| 13 | lower edge |
| 14a, 14b | first pair of closure panels |
| 14c, 14d | second pair of closure panels |
| 15a, 15b, 15c, 15d | first folding lines |
| 16a, 16b, 16c, 16d | second folding lines |
| 17a, 17b, 17c, 17d | additional folding lines |
| 18c, 18d | distal edges |
| 19a | tongue |
| 19b | receiving opening |
| 30 | cup for cold beverages |
| 34a, 34b | first pair of closure panels |
| 34c, 34d | second pair of closure panels |
| 41a, 41b | first and second openings |

CITATION LIST

Patent Literature

GB 2380397 A

US 2010/314434 A1

US 2014/042217 A1

US 2002/0052286 A1

The invention claimed is:

1. A paper cup, comprising:

a base;

a sidewall;

said base and said sidewall together defining a space for receiving liquid or food;

an upper end portion of the cup consisting of a first and second pair of opposing closure panels, whereby each of the closure panels is attached to an upper edge of the sidewall via a respective first folding line, and each of the closure panels of one pair is attached to the closure panels of the other pair via respective second folding lines;

said closure panels being foldable into a closed position to form a lid of the cup;

each panel of said first pair containing two additional folding lines, each of which extends from a distal edge of the respective panel to end points of the respective first folding line, to enable folding inwards;

wherein, upon folding to the closed position, a first panel of said second pair is partly inserted below a second panel of said second pair, and the panels of said second pair close the upper end portion; and wherein the additional folding lines together with the respective first folding line form a triangle shape with a cut or pointed apex and with a curved base, and wherein the first panel of said second pair is sandwiched between the second panel of the second pair and the first pair of closure panels in the closed position.

2. The paper cup according to claim 1, wherein one of the panels of said second pair contains an opening in its first folding line to form a spout.

3. The paper cup according to claim 1, wherein the first and second panels of the second pair contain a first opening and a second opening, respectively, to form a hole for a straw in the closed position.

4. The paper cup according to claim 1, wherein the second panel of said second pair comprises a tongue in its distal edge, which tongue is locatable in a receiving opening in the first panel of said second pair to retain the panels in the closed position.

5. The paper cup according to claim 1, wherein the material of the paper cup is barrier coated paperboard.

6. The paper cup according to claim 1, wherein at least one length of the panels of the second pair is greater than at least one length of the panels of the first pair.

7. The paper cup according to claim 6, wherein the ratio of said lengths is in the range 4:3 to 5:3.

8. The paper cup according to claim 1, wherein each of the panels of the first pair has a length that is less than 50% of the width of the panels of the second pair and wherein in the closed position the panels of the first pair do not cover or close the entire upper end portion.

9. The paper cup according to claim 1, wherein each of the panels of the second pair has a length that is greater than 50% of the width of the panels of the first pair.

10. The paper cup according to claim 1, wherein the lid is concave in the closed position.

11. A blank for a paper cup, the blank comprising:

a base;

a sidewall;

said base and said sidewall together defining a space for receiving liquid or food;

an upper end portion of the sidewall consisting of a first and second pair of opposing closure panels, whereby each of the closure panels is attached to an upper edge of the sidewall via a respective first folding line, and each of the closure panels of one pair is attached to the closure panels of the other pair via respective second folding lines;

said closure panels being foldable into a closed position to form a lid;

each panel of said first pair containing two additional folding lines, each of which extends from a distal edge of the respective panel to end points of the respective first folding line, to enable folding inwards;

wherein, upon folding to the closed position, a first panel of said second pair is partly inserted below a second panel of said second pair, and the panels of said second pair close the upper end portion;

wherein the additional folding lines together with the respective first folding line form a triangle shape with a cut or pointed apex and with a curved base and wherein in the first panel of said second pair is sandwiched between the second panel of the second pair and the first pair of closure panels in the closed position.

12. A paper cup, comprising:

a base;

a sidewall;

said base and said sidewall together defining a space for receiving liquid or food;

an upper end portion of the cup consisting of a first and second pair of opposing closure panels, whereby each of the closure panels is attached to an upper edge of the sidewall via a respective first folding line, and each of the closure panels of one pair is attached to the closure panels of the other pair via respective second folding lines;

said closure panels being foldable into a closed position to form a lid of the cup;

each panel of said first pair containing two additional folding lines, each of which extends from a distal edge of the respective panel to end points of the respective first folding line, to enable folding inwards;

wherein, upon folding to the closed position, a first panel of said second pair is partly inserted below a second panel of said second pair, and the panels of said second pair close the upper end portion; and wherein the additional folding lines together with the respective first folding line form a triangle shape with a cut or pointed apex and with a curved base, and wherein in the closed position, the panels are in a stacked configuration.

13. The paper cup according to claim 12, wherein the second pair of closure panels do not have additional folding lines.

* * * * *